US010400464B2

(12) United States Patent
Garceau et al.

(10) Patent No.: US 10,400,464 B2
(45) Date of Patent: Sep. 3, 2019

(54) STRUCTURE ORIENTATION USING MOTOR VELOCITY

(71) Applicant: NORCO INDUSTRIES, INC., Compton, CA (US)

(72) Inventors: Bernard F. Garceau, Vandalia, MI (US); Timothy D. Schultz, Mishawaka, IN (US)

(73) Assignee: NORCO INDUSTRIES, INC., Compton, CA (US)

( * ) Notice: Subject to any disclaimer, the term of this patent is extended or adjusted under 35 U.S.C. 154(b) by 0 days.

(21) Appl. No.: 16/161,791

(22) Filed: Oct. 16, 2018

(65) Prior Publication Data

US 2019/0048603 A1 Feb. 14, 2019

Related U.S. Application Data

(63) Continuation of application No. 15/944,947, filed on Apr. 4, 2018, now Pat. No. 10,145,134, which is a continuation of application No. 14/634,830, filed on Feb. 28, 2015, now Pat. No. 9,938,737.

(60) Provisional application No. 61/946,696, filed on Feb. 28, 2014.

(51) Int. Cl.

| | |
|---|---|
| ***E04G 23/06*** | (2006.01) |
| ***B66F 7/14*** | (2006.01) |
| ***B66F 3/46*** | (2006.01) |

(52) U.S. Cl.

CPC ..... *E04G 23/065* (2013.01); *B66F 3/46* (2013.01); *B66F 7/14* (2013.01)

(58) Field of Classification Search

CPC ..... B66F 3/46; B66F 7/14; E04G 23/065

See application file for complete search history.

(56) References Cited

U.S. PATENT DOCUMENTS

| | | | | |
|---|---|---|---|---|
| 3,265,357 A * | 8/1966 | Schilling | B66F 3/46 | 254/89 H |
| 3,595,525 A * | 7/1971 | Yaste | B66F 3/24 | 254/2 B |
| 4,599,034 A * | 7/1986 | Kennedy | B66F 7/025 | 254/89 R |
| 5,134,386 A | 7/1992 | Uriarte | | |
| 5,143,386 A * | 9/1992 | Uriarte | B60S 9/02 | 180/41 |

(Continued)

FOREIGN PATENT DOCUMENTS

WO WO-2015026246 A2 * 2/2015 ..... B65D 90/143

*Primary Examiner* — Marc Carlson

(74) *Attorney, Agent, or Firm* — Vorys, Sater, Seymour and Pease LLP

(57) ABSTRACT

Aspects herein relate to using motor velocity as feedback for controlling the extension or retraction of jacks for control of the angular orientation of a structure, or other means for accomplishing the same. Embodiments include a structure orientation control apparatus comprising one or more jacks configured to support a structure, one or more jack drive mechanisms coupled to at least one of the one or more jacks, the one or more jack drive mechanisms configured to extend or retract the one or more jacks, and a jack controller configured to cause the one or more jack drive mechanisms to extend or retract the one or more jacks based on a jack command. The jack controller may be configured to monitor one or more jack velocities during extension or retraction.

30 Claims, 9 Drawing Sheets

(56) References Cited

U.S. PATENT DOCUMENTS 5,484,134 A * 1/1996 Francis ..... B66F 7/04 254/2 B
5,911,408 A * 6/1999 Berends ..... B66F 7/04 254/2 B
5,954,160 A * 9/1999 Wells, Sr. ..... B66F 7/28 187/203
6,315,079 B1 * 11/2001 Berends ..... B66F 3/46 187/203
6,634,461 B1 * 10/2003 Baker ..... B66F 3/46 187/210
7,193,381 B2 * 3/2007 Ford ..... H01R 13/641 254/418
7,199,534 B2 * 4/2007 Ford ..... B66F 3/46 254/418
7,208,896 B2 * 4/2007 Ford ..... B60S 9/04 254/418
7,219,770 B2 * 5/2007 Baker ..... B66F 3/46 187/210
7,500,816 B2 * 3/2009 Berends ..... B66F 3/46 187/210
8,028,973 B2 * 10/2011 Ford ..... H02P 6/16 187/203
8,256,577 B2 * 9/2012 Kritzer ..... B66F 3/46 187/215
8,567,761 B2 * 10/2013 De Jong ..... B66F 3/46 254/134
9,114,684 B2 * 8/2015 Maurer ..... B60G 17/017
9,223,302 B2 * 12/2015 Maurer ..... H02P 29/60
9,334,145 B2 * 5/2016 Fagan ..... B66F 3/46
9,938,737 B1 * 4/2018 Garceau ..... E04G 23/065
10,145,134 B2 * 12/2018 Garceau ..... E04G 23/065
2001/0043450 A1 * 11/2001 Seale ..... F01L 9/04 361/160
2004/0037653 A1 * 2/2004 Kelso ..... E02D 27/48 405/236
2004/0211945 A1 * 10/2004 Maggiori ..... B66F 3/08 254/89 R
2005/0210713 A1 * 9/2005 Mennen ..... B25J 9/1628 37/195
2008/0121853 A1 * 5/2008 Schultz ..... B66F 7/28 254/264
2009/0189134 A1 * 7/2009 Ford ..... B60S 9/12 254/418
2010/0258774 A1 * 10/2010 Stokes ..... B66F 3/24 254/89 R
2012/0262099 A1 * 10/2012 Kaarstad ..... E02B 17/08 318/400.15
2013/0240300 A1 * 9/2013 Fagan ..... B66F 3/46 187/210
2013/0240812 A1 * 9/2013 Helmich ..... B66F 3/46 254/89 H
2014/0214283 A1 * 7/2014 Maurer ..... H02P 29/00 701/49

* cited by examiner

STRUCTURE ORIENTATION USING MOTOR VELOCITY

CROSS-REFERENCE TO RELATED APPLICATIONS

This U.S. patent application is a continuation of U.S. patent application Ser. No. 15/944,947 filed Apr. 4, 2018, which is a continuation of U.S. patent application Ser. No. 14/634,830 filed Feb. 28, 2015, now U.S. Pat. No. 9,938,737, which claims priority to and the benefit of Provisional U.S. Patent Application Ser. No. 61/946,696 filed Feb. 28, 2014, all of which are incorporated by reference herein in their entirety.

TECHNICAL FIELD

The disclosures herein relate in general to control of the orientation of structures in regard to a reference angle. More particularly, aspects herein relate to using motor velocity as a feedback variable for controlling the extension or retraction of jacks to effect such orientation.

BACKGROUND

Structures can be emplaced temporarily, constructed semi-permanently, or erected permanently for various commercial, industrial, or personal reasons. Whether such structures are positioned for minutes or years, it is desirable to align such in accordance with a reference angle while arranging the structures. For example, in occupied structures, it is important that floors, ceilings and walls be level, and/or reflect the design such that both load bearing and aesthetics are accomplished as intended. In industrial applications, a drill or other tool may suffer from reduced efficiency or failure based on deviations to an expected orientation. Examples of movable or self-propelled structures that may benefit from alignment include motor homes, recreational vehicles, cranes, elevated work platforms, military vehicles, and others. Pre-assembled or rapid deployment living or working quarters for use in undeveloped areas provide examples of semi-permanent or enduring structures that may benefit from angular alignment during construction.

Rather than develop a carefully graded surface on which to place the structure, the structure itself can be designed to include mechanisms allowing it to modify its alignment in regard to one or more reference angles using integral or couple-able means for aligning the structure, such as one or more mechanical jacks, wedges or cams, screws, or collapsible supports (including but not limited to, e.g., inflatable devices). Such devices are frequently controlled with some degree of automation using at least a power supply, and feedback can be received from various sensors or electrical components utilized in the system. To safely and efficiently utilize these and other structures, systems and methods can coordinate the efforts of various means of aligning a structure with a reference angle. A common reference angle is the direction of gravitational pull, but any angle may be defined and utilized.

In embodiments employing electro-mechanical jacks, one or more feet or surface-contacting portions of jacks may be extended to contact the ground and establish a rigid support base for the structure. By extending and retracting jacks associated with different locations on the structure, the structure may be aligned at any reference angle. Such jacks can be, for example, hydraulically powered or driven by electric motors.

However, even with assistance raising and lowering portions of the structure to modify alignment with a reference angle, precise control over two- and three-dimensional orientation of the structure requires not only automation of a single raising or lowering motion, but coordination between all means for aligning the structure. Further, techniques can be employed to reorient a structure after an initial setup, such as when settling earth changes the structure's orientation in regard to the reference angle(s), or based on a user's needs and preferences.

SUMMARY

Techniques can be employed to modify one or more angles of a structure. Such techniques may include the use of velocities associated with one or more jack motors associated with jacks acting on the structure. Control signals to the jack motors are based on the velocities and one or more sensors providing data related to the angles of the structure.

Embodiments herein may disclose a jack control system for leveling a structure. In some of these embodiments, the jack control system comprises two or more jacks mounted about the structure, with the two or more jacks each coupled to a drive mechanism configured to extend or retract the jack associated therewith at one or more jack velocities. The jack control system may further comprise a velocity sensor that is connected to each of the drive mechanisms and configured to measure the one or more jack velocities of the jack associated therewith. Further, the jack control system may comprise a controller that is connected to at least one of the two or more drive mechanisms and the velocity sensor associated therewith, where the controller configured to actuate at least one of the two or more drive mechanisms to extend or retract the jack associated therewith, and where the controller is further configured to modify the jack velocity provided by at least one of the drive mechanisms in response to a change in jack velocity provided by another one of the drive mechanisms.

In some of these embodiments, the jack control system may be, in response to a decrease in the jack velocity provide by at least one of the drive mechanisms, configured to increase the jack velocity provided by another one of the drive mechanisms providing a higher jack velocity. Alternatively, the jack control system may be, in response to a decrease in the jack velocity provide by at least one of the drive mechanisms, configured to decrease the jack velocity provided by another one of the drive mechanisms providing a lower jack velocity.

In even other embodiments, the jack control system may be, in response to an increase in the jack velocity provide by at least one of the drive mechanisms, configured to increase the jack velocity provided by another one of the drive mechanisms providing a lower jack velocity. Alternatively, the jack control system may be, in response to an increase in the jack velocity provide by at least one of the drive mechanisms, configured to decrease the jack velocity provided by another one of the drive mechanisms providing a higher jack.

Various aspects will become apparent to those skilled in the art from the following detailed description and the accompanying drawings.

DETAILED DESCRIPTION

Figure 1:
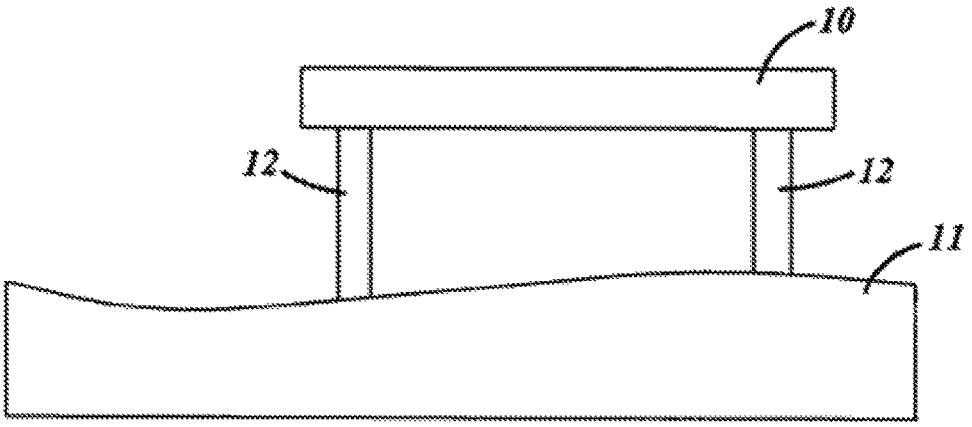
FIG. 1 is a schematic front view of a structure supported by two jacks on the ground in an original position before the jacks have been actuated to adjust the attitude of the structure.

The disclosures herein generally relate to systems and methods for controlling jacks (or other means) for adjusting an angle of a structure which is oriented in regard to a reference angle in an at least a partially automated fashion. Specifically, a common value used at least in part to govern control of the angle of the structure is a velocity associated with the jacks. As used herein, velocity in reference to such motors generally refers to their revolutions per minute (RPM); however, as detailed below, velocity may refer to other parameters such as the rate of extension of the jacks.

By measuring velocity associated with jacks, a controller can determine (from a previously indeterminate state) at least when one or more jacks contact ground and begin bearing structure load, and thereafter begin leveling by using information related to jack velocity to assist with leveling a structure. Multiple operating modes can be built around these determinations, including a grounding mode that ensures a predetermined number of jacks are contacting the ground or bearing at least a partial load prior to leveling, a leveling mode to orient the structure according to a reference angle, an unloading mode, and others. Alternatively, combinations of different functions or all such functions can be integrated into a unified technique for managing support and orientation of structures using jacks.

As suggested, various jack functions are useful to controlling the angle of a structure. For example, determining jack stroke limit (i.e., maximum extension and retraction), contact of one or more jacks with the ground, relative jack load, et cetera, can be used to modify relative angles, balance jack load, coordinate activity of jacks, et cetera.

As used herein, "jack velocity" refers to a velocity associated with a jack or jack driving mechanism. The jack velocity can, in embodiments, be the motor velocity of a jack motor driving a jack (or multiple jacks). Alternatively, the jack velocity can be the velocity of a moving part of a jack itself. Jack velocities can be measured according to a rotational rate (e.g., rotations per minute), but can be measured according to other quantities as well (e.g., inches per minute). A "jack rate" is the rate at which the moving portion of a jack in contact with the structure changes. In some embodiments, a jack velocity and jack rate can be the same quantity. In alternative embodiments, the jack velocity and jack rate are not the same quantity, but may be related (e.g., jack rate is a product of jack velocity, screw pitch, and load borne by jack, and/or other variables). In still another embodiment jack rate and jack velocity are not mathematically comparable by a single relationship. As used herein, a "jack command" is an automatic or manual command to being, cease, or modify extension or retraction of one or more jacks. Jack commands may include, for example, commands to extend, ground, or load jacks; commands to retract or unload jacks; commands to level a structure using the jacks; commands to modify angular orientation using the jacks; and others.

Control of the structure angle is accordingly consequent to individual positions of the jacks, and requires additional information related to each jack such as whether it has reached or is nearing a stroke limit, or if it is in contact with the ground and is bearing a portion of the structure load. The necessary information can be gleaned in real-time based at least in part on the jack velocity. For example, when a jack makes ground contract after movement from a retracted state, the motor velocity will (at least temporarily) decrease as the jack begins to bear the structural load. In this way, ground contact with all jacks can be confirmed prior to leveling, thus avoiding excess load on any one jack, leveling in an unstable position, or improper leveling that will need to be repeated. Such aspects can be referred to as "grounding operations."

Various jack velocity values can be identified or retrieved, and stored as reference velocities associated with particular states or behavior in jacks and jack motors. Motor velocity values can, but need not be, calculated by, e.g., counting revolutions in a jack motor or jack involving rotating components. Examples of jack motor velocities can include, but are not limited to, e.g., instantaneous RPM, average RPM over time, increase or decrease in RPM, rate of increase or decrease in RPM, RPM curves, and others. Examples of reference velocities can include, e.g., reference jack velocity, other reference velocity, reference velocity curve, or reference velocity profile. In some embodiments, reference velocities need not comprise fixed values, but may instead comprise dymanic values that are modified and updated in conjuction with systems and methods herein, and may be changed one or more times during a single iteration of a methodoly or algorithm. Velocities or values related thereto can be measured instantaneously or over a period of time. Periods of time can include, for example, one sixteenth of one second, one eighth of one second, one quarter of one second, one half of one second, one second, two seconds, five seconds, ten seconds, fifteen seconds, and so forth. Periods of time can be shorter as well, such as periods of 10 milliseconds, 25 milliseconds, 50 milliseconds, and soforth.

Reference velocities are compared to those observed in operation to discern state or behavior, which the controller uses to modify action of the jack motors in furtherance of controlling the structure angle.

Figure 4:
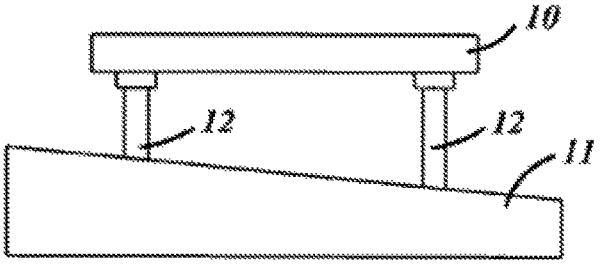
FIG. 4 is a schematic front view of a pair of jacks supporting a structure over ground.

In this document, the term "structure" refers to a body, such as the one shown at 10 in FIG. 4, which is to be raised relative to the ground 11 and its attitude adjusted in preparation for performing some operation or for accommodating certain activities or arrangements to be carried out on or with the structure 10.

The term "jack" refers to a mechanism for raising one or more objects by means of force applied with a lever, screw, press, or other components. Jacks can be driven by motors. The motors can be powered by direct electrical current (e.g., DC electrical power) or other techniques.

Figure 5:
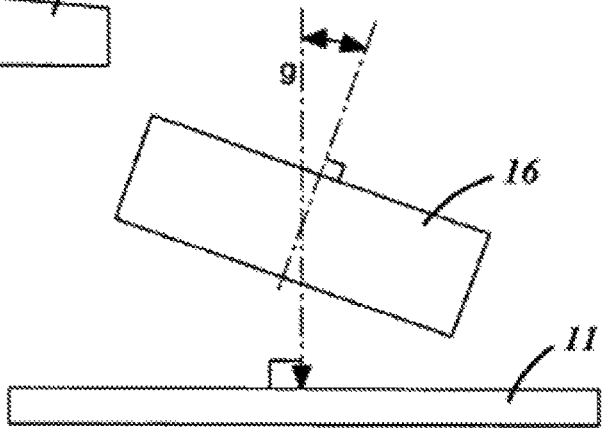
FIG. 5 is a schematic front view of a tilt sensor shown tilted relative to earth gravity.
Figure 6:
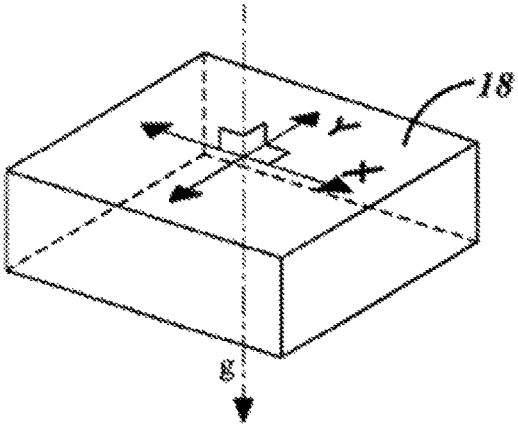
FIG. 6 includes a schematic orthogonal view of a dual-axis tilt sensor shown oriented relative to earth gravity.
Figure 7:
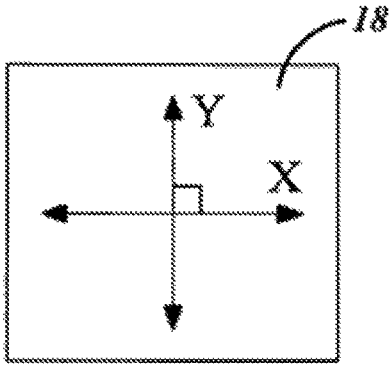
FIG. 7 includes schematic top view of the dual-axis tilt sensor of FIG. 6 shown oriented relative to earth gravity.
Figure 8:
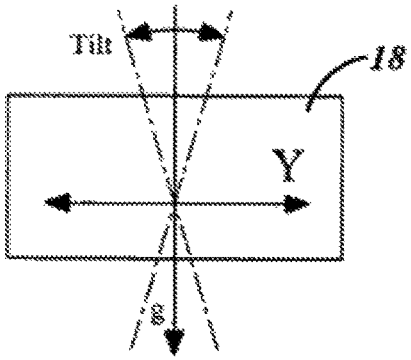
FIG. 8 includes schematic side view of the dual-axis tilt sensor of FIG. 6 shown oriented relative to earth gravity.
Figure 9:
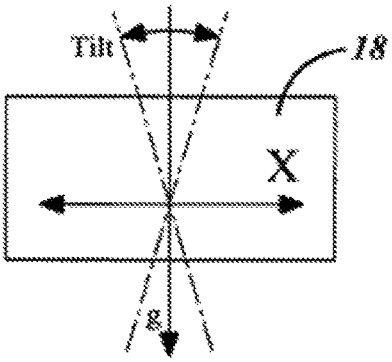
FIG. 9 includes schematic front view of the dual-axis tilt sensor of FIG. 6 shown oriented relative to earth gravity.
Figure 18:
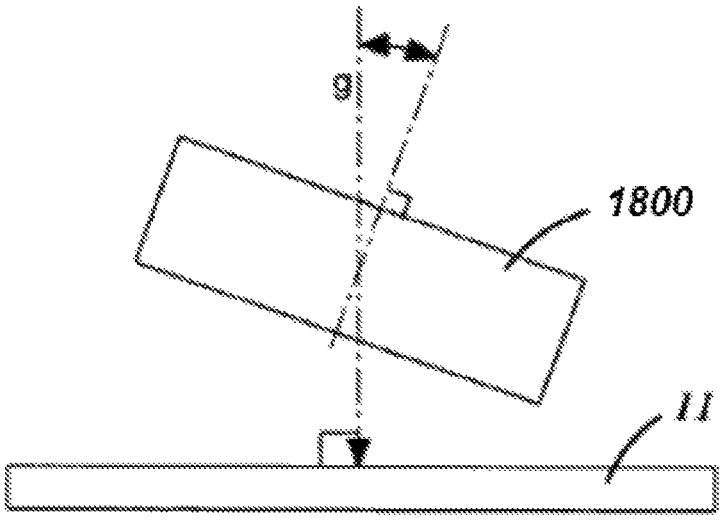
FIG. 18 is a schematic front view of a three axis accelerometer.

The term "tilt sensor" refers to a sensor, such as the sensor shown at 16 in FIG. 5, designed to detect the angle of tilt between, for example, a vertical axis through the sensor 16 and Earth gravity "g". The term "dual axis tilt sensor" refers to a tilt sensor capable of detecting the angle between the sensor and the Earth's gravity in two tilt axes, each perpendicular to the other. Tilt sensors can be configured to send an angular signal to a controller by which the angular signal represents the attitude, pitch, tilt, orientation, et cetera, of the supported structure. The angular signal can be used by the controller and/or comparator to assist with determining changes needed to align the structure according to a reference angle or direction. The changes are then realized by way of extending or retracting grounded jacks. Angular signals herein can include any digital or analog input indicating one or more axis angles and/or rotations relative to one or more reference angles, and/or derivatives thereof (e.g., angular rates of change such as velocity or accelerations). In other embodiments, the tilt sensor may be a three axis accelerometer 1800 as illustrated in FIG. 18.

In FIGS. 6-9 a dual axis tilt sensor is shown at 18. The two tilt axes that the tilt sensor uses as references may be any two imaginary straight lines extending perpendicular to one another in a plane defined by the respective points where the jacks of a leveling system engage a structure 10 that the jacks are supporting. Although this embodiment of the invention may be adapted to level structures of a variety of configurations using any number of jacks and assigning any two imaginary lines as tilt axes, to simplify this discussion this description will refer to a rectangular structure 10 supported by jacks located in each of its four corners, and will refer to a longitudinal tilt axis X extending the length of the structure 10 and a lateral tilt axis Y extending perpendicular to the longitudinal tilt axis X and along the width of the structure 10 as shown in FIGS. 6-9.

"Operatively coupling" used herein describes components which act upon one another or communicate (one-way, two-way, or involving additional components). Such action can be accomplished through mechanical interaction of solid components which are directly connected or which exert forces on one another through various linkages or at a distance, or through the transmission of electricity or electrical signals through conductive media or wirelessly over the air. Such action can also be accomplished through fluid communication, which can be effected directly or through the direction of fluid matter through intervening or connecting components. These are only examples, and should not be construed as limiting or preventing the means by which components (both physical and logical) can interact in systems and methods described herein.

Figure 2:
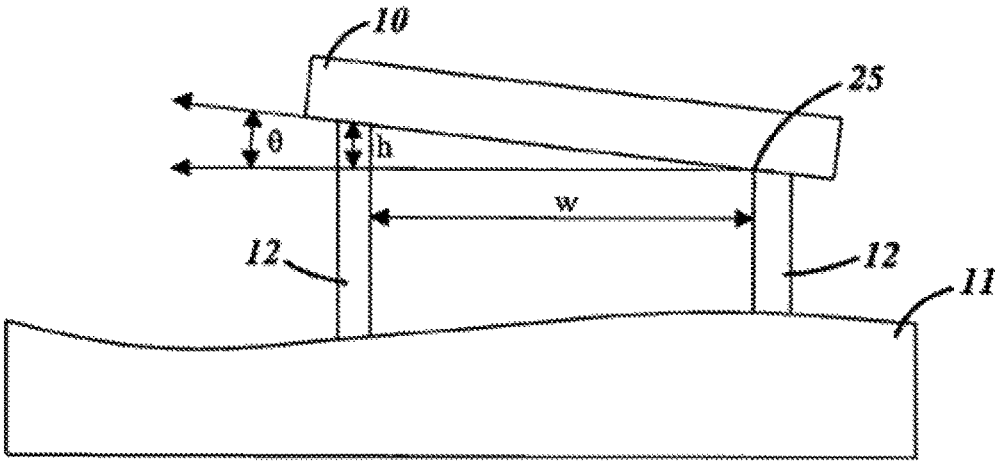
FIG. 2 is a schematic front view of the structure and jacks of FIG. 1 with one jack extended from the original position shown in FIG. 1 to illustrate the basic relationship between structure attitude and jack stroke when a desired attitude is achieved by extending one jack.

Turning to the drawings, FIGS. 1 and 2 schematically illustrate the basic relationship between structure position and jack stroke in a simplified two system in which one jack extends or retracts while the other jack remains stationary. In such systems a stationary pivot point of the structure is located at the stationary jack. In most applications there are at least four jacks supporting a structure in spaced locations, e.g., near each of the four corners of a generally rectangular structure. However, for the sake of simplicity, as with FIGS. 1 and 2, this document will address the operation of the attitude adjustment system with respect to only two adjacent jacks.

The following parameters are used to trigonometrically describe the total attitude adjustment capability of a structure positioning system:

h=maximum stroke of jack w=distance between any two jacks.

If one jack "uses up" its entire stroke (e.g., the rod which moves in relation to the base to exert force on the structure is fully extended or retracted) and the other remains stationary, the largest angle (θ) through which the structure may be tilted in the axis of the two jacks is calculated using the following equation:

$$\theta=\tan^{-1}(h/w).$$

While the above describes a two-jack configuration, four- and six-jack arrangements are also utilized according to similar techniques.

When designing a structure attitude adjustment system, the jack stroke and placement can be chosen to provide that the system moves a supported structure through a desired range of attitudes. In some mobile structure attitude adjustment applications, amounts of distance between supporting jacks may be dependent on structure geometry and the placement of various structure supports or components. However, even where jacks must be planned around, for example, axles, wheels, engines, and non-load bearing portions, the designer can develop or select jacks appropriate for the application, to include development or selection of jacks having different stroke lengths. However, costs can be reduced, the structure made lighter and more stable, and leveling can be made faster where jack stroke length is optimized. In some embodiments, shorter jack stroke lengths are preferable. Nonetheless, jack stroke lengths must be long enough to ensure the jacks are able to transition through a predetermined desired range of attitudes from different starting positions.

Figure 10:
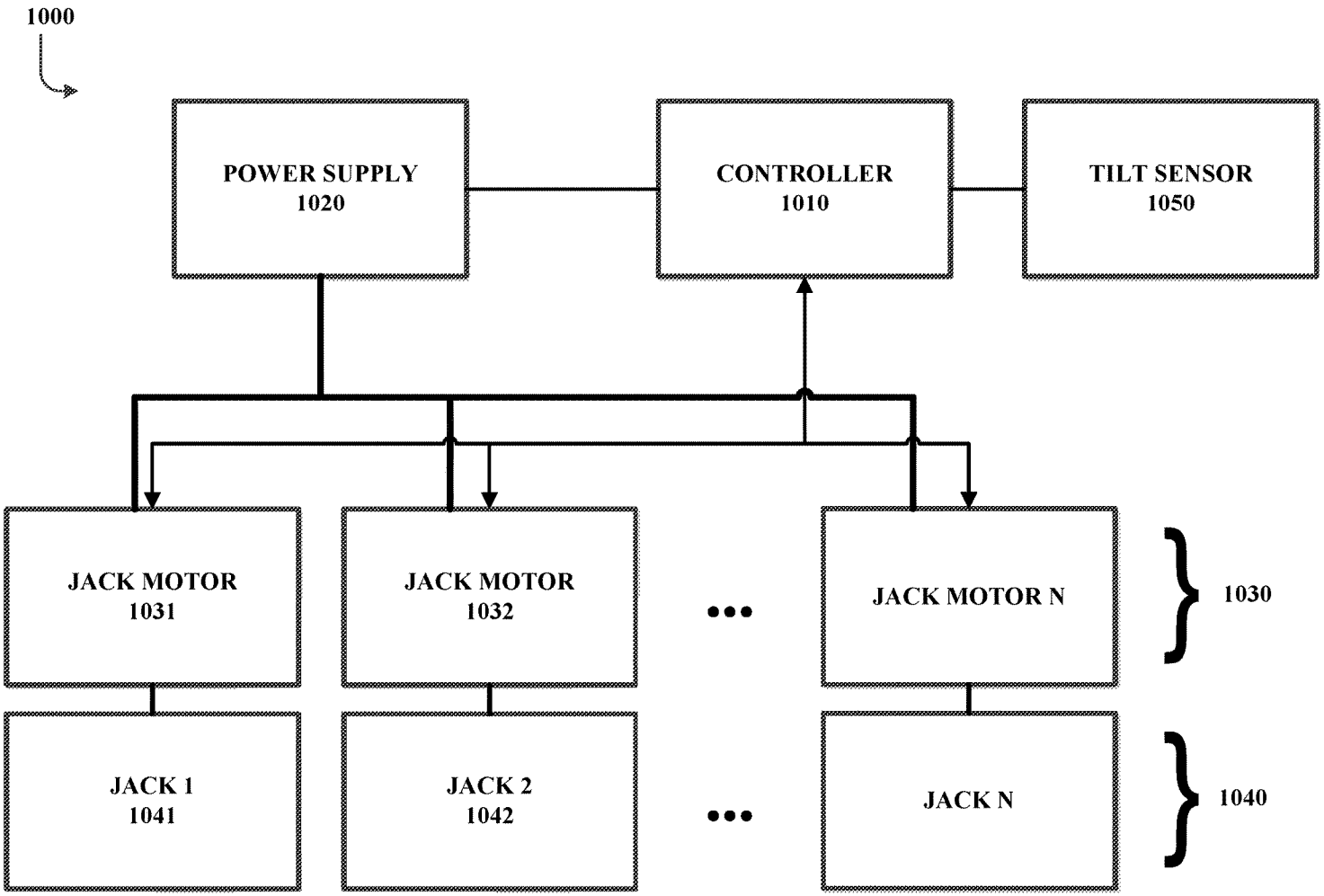
FIG. 10 depicts a block diagram view of a system for controlling the angular orientation of a structure.

To such effect, system 1000 of FIG. 10 includes a structure attitude adjustment apparatus that increases structure attitude adjustment ranges for structures supported by jacks of a given stroke length. System 1000 can be incorporated in a mobile structure attitude adjustment system. The structure attitude adjustment system 1000 is, in turn, mountable to a mobile structure whose attitude is to be adjusted. As shown in FIG. 10 other components of system 1000 are operatively coupled to each jack of the plurality of jacks

1040. Plurality of jacks 1040 are mounted at spaced-apart locations around the structure 10 whose attitude is to be adjusted and are extendable to contact the ground beneath the structure 10 and to support the structure 10 on the ground at the spaced-apart locations.

FIG. 10 illustrates a block diagram view of a system 1000 for controlling the angular orientation of a structure. System 1000 includes jack controller 1010. Jack controller 1010 is operatively coupled with a tilt sensor 1050 associated with the structure (not pictured) on which plurality of jacks 1040 operates. Tilt sensor 1050, jack controller 1010, and/or power supply 1020 may be located on the structure, or offboard. In onboard embodiments, tilt sensor 1050 can be a sensor as described herein. In alternative embodiments where tilt sensor 1050 is not physically disposed on the structure, the angle sensor may employ camera or other device observing structure). Power supply 1020 can be controlled, at least in part, using jack controller 1010, or alternatively plurality of jack drives 1030 can draw requisite power from power supply 1020 in accordance with instructions from jack controller 1010 such that jack controller 1010 need not exercise direct control over power supply 1020.

The structure attitude adjustment system 1000 includes a jack controller 1010 that is also the controller for the structure attitude adjustment system 1000. As is further shown in FIG. 10, jack controller 1010 receives signals representing structure attitude from the tilt sensor 1050. These signals can be received through an analog-to-digital converter in embodiments. Jack controller 1010 also receives feedback signals from each of a plurality of jack drives 1030 from velocity sensors such as tachometers, Hall effect sensors, optical encoders, and others. Such information may also be processed or received through one or more analog-to-digital converters. In various embodiments, it is understood that system 1000 may employ any number of analog-to-digital converters or elements capable of converting signals from different signal sources (e.g., by internally multiplexing signals received via a plurality of channels).

Jack controller 1010 is capable of sending control signals to at least plurality of jack drives 1030 through, for example, an I/O port, a relay control, H-bridge relays, or other means of operatively coupling such components. Jack controller 1010 is also capable of sending control signals to tilt sensor 1050 through similar techniques. Communication between components herein can be accomplished through wired or wireless techniques. Jack controller 1010 includes a central processing unit, a software-implemented digital signal processor, and control algorithms. Such aspects can be realized using non-volatile computer readable media, or accessed through a network connection, using configurations such as that shown in e.g., FIG. 17.

In an embodiment, jack controller 1010 possesses knowledge of structure and jack geometry to assist with calculations. However, in an alternative embodiment, jack controller 1010 can discover relationships between jacks and other components through a calibration routine. For example, jack controller 1010 can actuate one or more jack motors and complete a velocity-based grounding routine (described herein). Once all jacks are grounded and loaded, one or more jack motors or jacks can be driven for a predetermined number of rotations, and jack controller 1010 can receive information regarding changes to the attitude of the structure based thereon. Given the changes, jack controller 1010 can derive relationships between jacks to facilitate calibration for use with future leveling procedures. In still another alternative arrangement, motor velocity alone can be used in all circumstances.

Power supply 1020 provides electrical power to at least a plurality of jack drives 1030, and may also provide power to jack controller 1010, tilt sensor 1050, or other components in various embodiments. Power supply 1020 can include one or more batteries, generators, power converters or inverters, connections to infrastructure, and other components used for providing at least electrical power. Other power supplies can be utilized where non-electric means are employed in conjunction with or alternative to electrical power.

Figure 3:
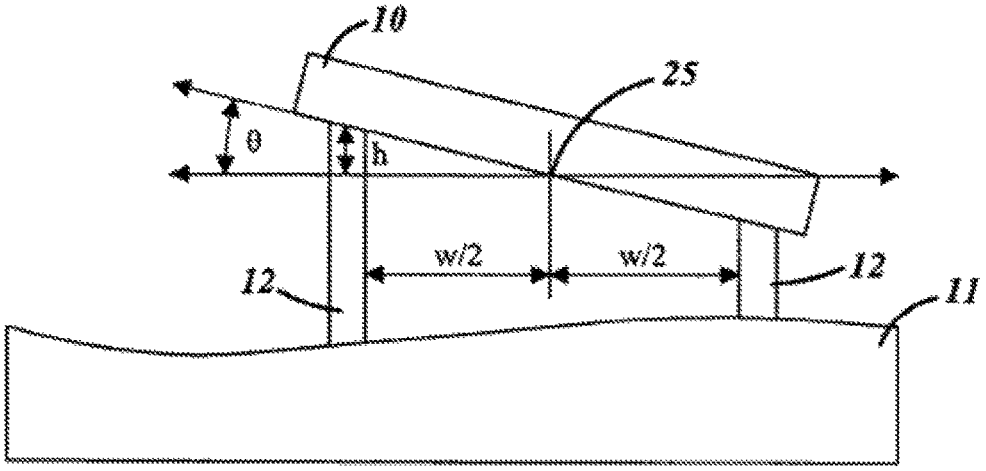
FIG. 3 is a schematic front view of the structure and jacks of FIG. 1 with one jack extended from its original position shown in FIG. 1 and the other jack retracted from its original position shown in FIG. 1 to illustrate the basic relationship between structure attitude and jack stroke when a desired attitude is achieved by extending one jack and retracting the other jack.

Jack controller 1010 is programmed to adjust the attitude of a structure 10 by controlling the operation of plurality of jacks 1040 and coordinating their movement. Jack controller 1010 is further programmed to coordinate the movement of plurality of jacks 1040 in a given axis of tilt X, Y by selecting and commanding one of plurality of jacks 1040 to retract and selecting and commanding another to extend so as to increase the range of possible structure attitudes for a given jack stroke length. As shown in the diagram of FIG. 3, when jack controller 1010 allows two or more of plurality of jacks 1040 to stroke by the same amount, but in opposite directions, the pivot point 25 of the structure 10 is disposed midway between the two of the plurality of jacks 1040 instead of at one of the plurality of jacks 1040 as is the case when only one jack among plurality of jacks 1040 is extended as shown in FIG. 2. Causing two of the plurality of jacks 1040 to move in opposite directions thus increases the maximum tilt of the structure 10 according to the equation:

$$\theta=\tan^{-1}(2h/w).$$

In embodiments, a system tilt capability can be increased by a factor of 1.5× using this method. For small tilt angles, the system capability is increased by nearly a factor of two.

The structure attitude adjustment system 1000 includes one or more jack drives 1030 for each jack. Each of the one or more jack drives 1030 drivingly connects to one or more respective jacks 1041, 1042, et cetera. Jack controller 1010 is connected to each of the one or more jack drives 1030 and is programmed to drive each jack drive 1031, 1032, et cetera, for control of each respective jack 1041, 1042, et cetera. For example, jack 1041 among the one or more jacks 1040 is driven in extension by causing associated jack drive 1031 to operate in one direction. In the same example, jack 1041 is driven in retraction by causing its jack drive 1031 to operate in the opposite direction. The one or more jack drives 1030 of the present embodiment can be, for example, direct-drive DC electric motors, or any suitable type of electric motor. Non-electric alternatives are also possible for use alone or in conjunction with electric driving means.

Jack controller 1010 is programmed to coordinate the movement of the plurality of jacks 1040 by commanding at least one of the one or more jack drives 1030 (or selected sets of jack drives) to extend or retract one (or more) of the one or more jacks 1040. This can be done in isolation, or while commanding at least one other of the one or more jack drives 1030 (or selected sets of jack drives) to extend or retract one (or more) of the one or more jacks 1040. Jack controller 1010 is programmed to identify and select whichever of plurality of jacks 1040 (or sets thereof) is best positioned to achieve or speed the achievement of a desired attitude by being driven in extension. Jack controller 1010 is also programmed to identify and select whichever of plurality of jacks 1040 or set of jacks is the "opposite" of the jack or set of jacks identified and selected for extension (e.g., the jack or set of jacks best positioned to augment the achievement of a desired structure attitude by being driven in retraction). Such identification can be based on manual programming, detected knowledge of jack location, or calibration of the system based on measured attitude adjustments through extension or retraction, among other techniques. To prevent the retracting of "opposite" jack or set of jacks from retracting too far and losing contact with the ground jack controller 1010 is also programmed to time-limit the movement of the retracting jack or set of jacks in some embodiments.

In addition to receiving control signals from jack controller 1010, plurality of jack drives 1030 provide feedback (including information related to plurality of jacks 1040 based on interaction there with) to jack controller 1010. Feedback provided includes at least velocity information, such as instantaneous and/or historical RPM values for each of jack drive 1031, jack drive 1032, et cetera.

The velocity information associated with one or more of plurality of jack drives 1030 is then used by jack controller 1010 to provide or modify control signals for one or more of plurality of jack drives 1030. Through control of plurality of jack drives 1030, the position or motion plurality of jacks 1040 is modified, individually and/or in combination, the angle of the structure is in turn adjusted.

Figure 11:
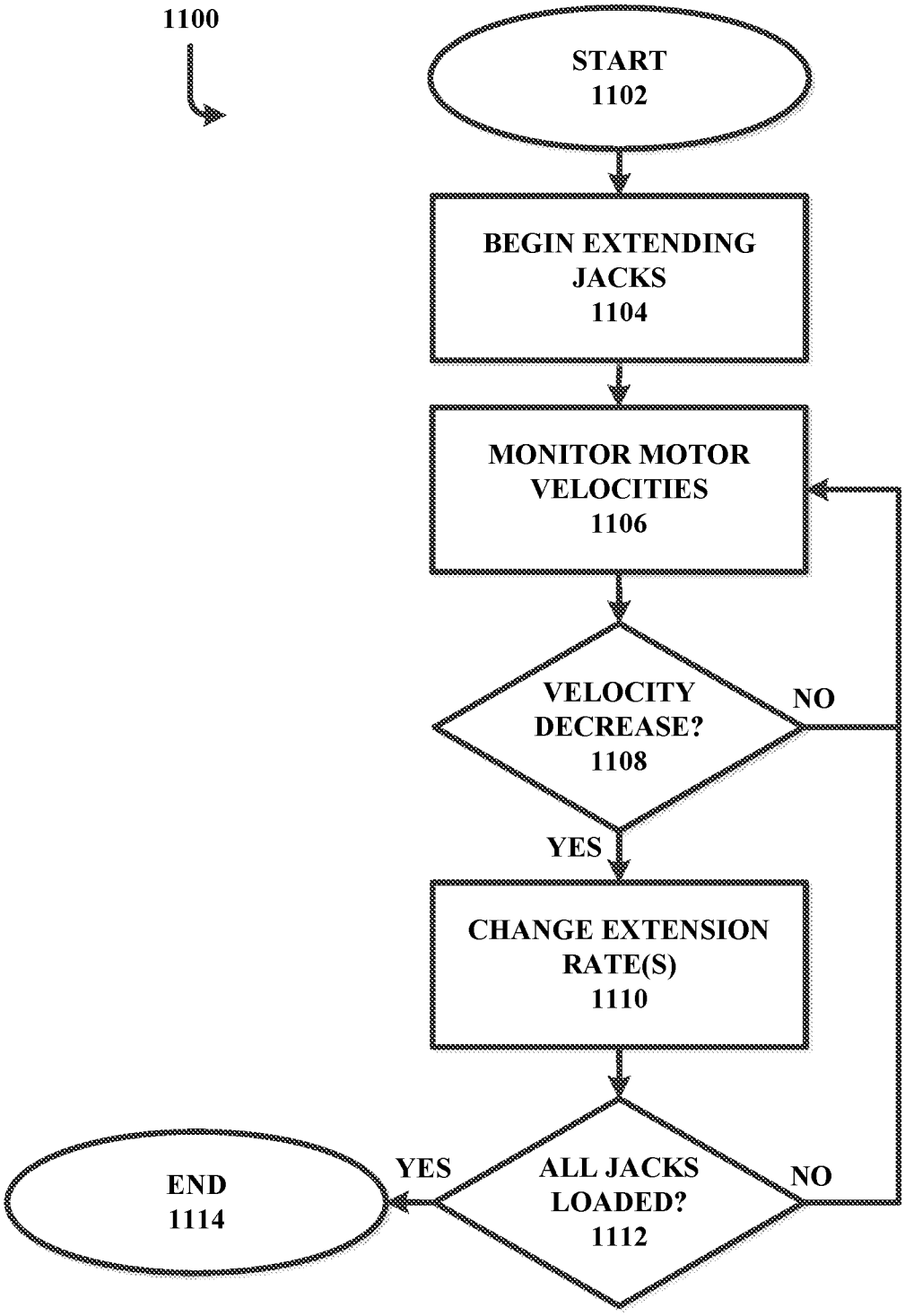
FIG. 11 depicts a methodology for extending and loading jacks supporting a structure

In some embodiments, no tilt sensor is present in a system. Thus, while FIG. 10 shows an embodiment having tilt sensor 1050, it will be appreciated that no tilt sensor is required to receive and process feedback according to velocities or other variables herein. In at least one embodiment, a user may manually cause extension or retraction of jacks by providing an input that commands controller 1010 to extend or retract jacks by actuating jack drives. On such a command, control may remain fully manual. In alternative or complementary embodiments, control may be semi-automatic. Semi-automatic control may include embodiments in which, e.g., a user controls extension or retraction but may be overridden by logic of controller 1010 based on detected velocities. In this way, the controller may, e.g., stop the jacks at the end of their stroke, stop or start the jacks based on grounding or unloading, modify velocities according to load conditions, etc. Still further, control may be automatic. Automatic control may include embodiments in which, e.g., instructions to extend result in exclusively feedback-based grounding or unloading based on velocities FIG. 11 depicts a methodology 1100 for extending and loading jacks supporting a structure (e.g., performing a grounding operation). When extending jacks, concurrently or sequentially loading multiple jacks without placing all load on a subset of the available jacks can prevent instability or damage to overloaded support members. Methodology 1100 begins at 1102 and proceeds to 1104 where extension of retracted jacks, not yet supporting the load of the structure, begins.

At 1106 motor velocities of one or more jacks are monitored. Based on the monitored motor velocity values, at 1108, a determination is made as to whether the velocity has decreased in one or more jacks. If the velocity has not changed, methodology 1100 recycles to 1106 and continues monitoring the motor velocities of one or more motors.

If the motor velocity has decreased at 1108, a determination that the extending jack is taking up the load of the structure can be inferred. In at least one embodiment, a comparison of the velocity decrease, monitored rates, profile, et cetera is completed, or the decrease is monitored for magnitude or length of time, to confirm that the monitored velocity information accords with a reduction in load on the jack.

Based on the velocity decrease determined at 1108, the extension rates are changed at 1110. Changing of the extension rates can include decreasing rates of extension in one or more jacks (e.g., jacks with lower motor velocity), increasing rates of extension in one or more jacks (e.g., jacks with higher motor velocity), or stopping movement in one or more jacks (e.g., jacks with lower motor velocity). By iteratively performing the aspects illustrated in FIG. 11, level or load can remain balanced or within acceptable imbalance parameters during initial loading and jack extension to avoid instability or damage to load bearing members.

After modifying the extension rates at 1110, a determination is made at 1112 as to whether all jacks are now loaded (e.g., equally, according to loading ratios or thresholds, within specification). If the determination at 1112 returns negative (e.g., some jacks still have motor velocity above relative or absolute value, no loading velocity profile detected), methodology 1100 recycles to 1106 (or optionally 1104 if jacks have ceased extension mid-methodology) where monitoring continues and retraction of jacks remaining under load is managed. If the determination at 1112 returns positive, methodology 1100 proceeds to end at 1114.

In at least one embodiment, a jack detected as loaded may become unloaded as other jacks are adjusted. For example, due to a slight lag in sensing and processing velocity, a jack that has been detected as grounded and/or stopped in extension may be re-lifted from the ground. Shifting, sinking, or other environmental factors may also influence such issues. In such instances, all jacks may be re-run (e.g., re-actuate jacks and confirm velocity or load, check loading through sensor means without energizing jack drives or attempting to extend jacks). For an embodiment in which re-running jacks drives or attempts to drive the jacks in extension, the velocities may be compared to a reference velocity. Alternatively, for an embodiment in which re-running jacks drives or attempts to drive the jacks in extension, jacks may be run in pairs or groups and their velocities compared against one another.

In an embodiment of methodology 1100, loading can be conducted according to a series of subroutines whereby each jack transitions from unloaded, to partially loaded, to loaded. Elements of methodology 1100 can be repeated such that each jack is or has been in a partially loaded state prior to proceeding to continue loading any jack from a partially loaded state. In an alternative or complementary embodiment of methodology 1100, loading can be conducted according to a series of subroutines intended to maintain level of the structure. Such level, or un-level within thresholds, can be maintained regardless of loading distribution, or can be maintained in a way that the loading distribution is unequal but within a threshold between jacks. As suggested above, regardless of leveling, jacks may be grounded individually, in pairs, or in groups of three or more (up to all jacks). Even in embodiments where no leveling is present, further detected information may be used to ensure loading is conducted safely and efficiently. For example, jack extension or retraction may be conducted in a manner preventing or correcting for twisting of a frame or other structural members on which the jacks act.

Figure 12:
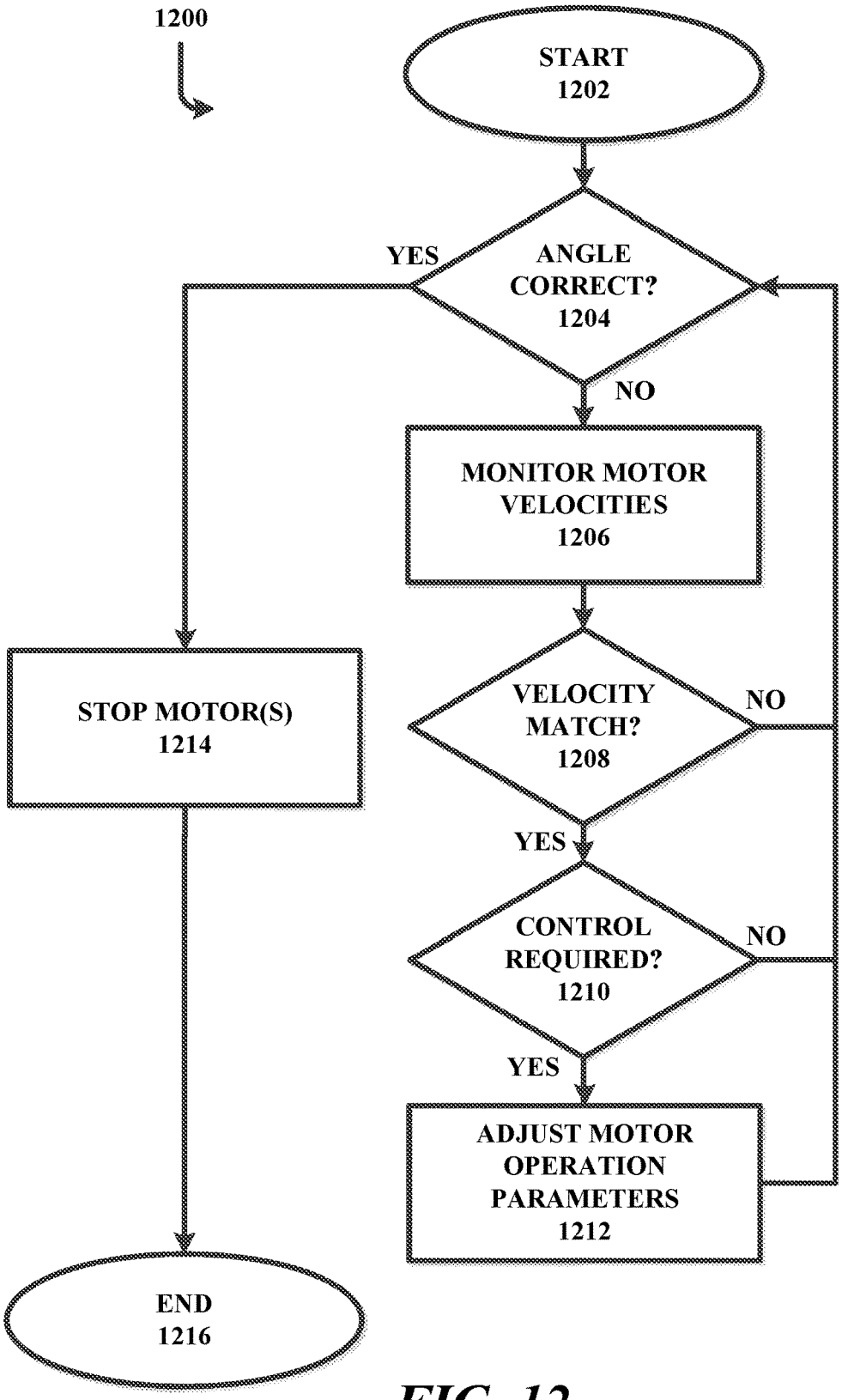
FIG. 12 depicts a methodology for controlling the angular orientation of a structure.

FIG. 12 illustrates a methodology 1200 for controlling the angular orientation of a structure using motor velocities. Methodology 1200 begins at 1202 and proceeds to 1204 where a determination is made as to whether the structure angle is correct. If the structure is oriented at the proper angle, methodology proceeds to stop operation of the motor(s) at 1214 and end at 1216. However, if the determination at 1204 returns negative, methodology 1200 advances to 1206 where motor velocities are monitored for one or more motors used to drive jacks affecting the angular orientation of the structure.

At 1208, a determination is made as to whether the monitored velocities match reference velocities stored. Stored reference velocities can include, but are not limited to, velocities or derivative values associated with maximum extension or retraction in one or more jacks, loaded or unloaded states (e.g., load-bearing state) in one or more jacks, and/or absolute or relative values of extension or retraction in a particular jack. If no match is determined through comparison, no state or behavior relevant to control is inferred, and methodology 1200 returns to 1204 to determine if the angle is correct before resuming monitoring at 1206, or stopping the motor(s) at 1214 and terminating at 1216.

If it is determined at 1208 that the monitored motor velocities match a reference velocity, a subsequent determination is made at 1210 as to whether control of one or more motors must be modified in furtherance of properly orienting the structure. If such modifications are necessary, modification to one or more motors occurs at 1212. Alternatively at 1208, a velocity match may cause at least one return to 1204. In such an embodiment, this may facilitate a confirmation that the structure's angular orientation is correct after the velocity or velocities are identified to match a reference velocity.

After parameters are adjusted at 1212 (or determining no control is required at 1210), methodology 1200 returns to 1204 to check if the angle is correct. By repeatedly determining if the angle is correct, unnecessary control signals can be avoided in the event the system is continuing adjustments, has self-corrected without subsequent signal, or has settled to a steady state.

Methodology 1200 can be repeated periodically or upon detected change to account for movement, settling, or other external influences that may or may not impact the accuracy of previous determinations resolved in methodology 1200.

Figure 13:
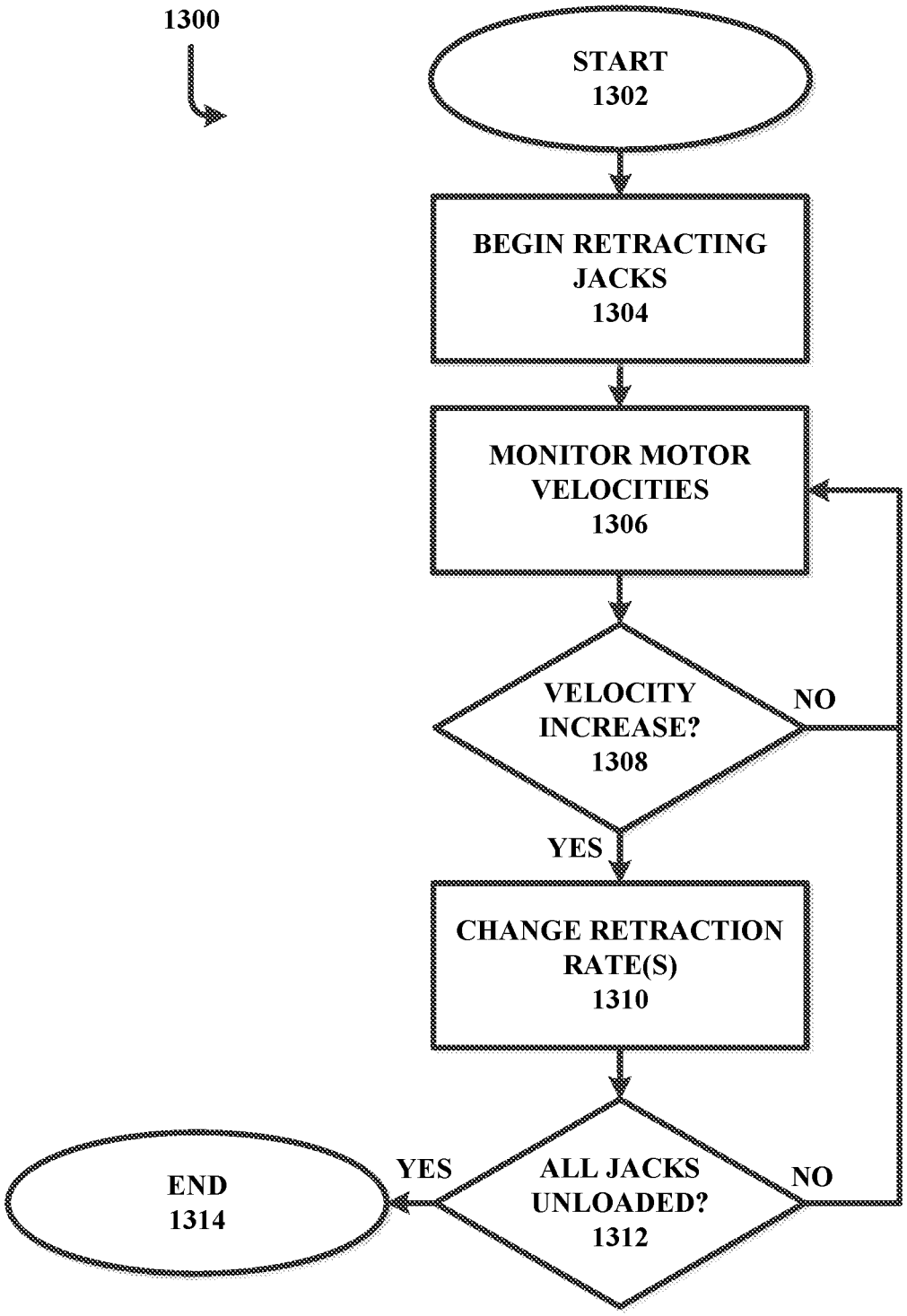
FIG. 13 depicts a methodology for unloading and retracting jacks supporting a structure.

FIG. 13 depicts a methodology 1300 for unloading and retracting jacks supporting a structure (e.g., an unloading operation or a retraction operation). When retracting jacks, maintaining at least partial level or load balance during unloading can prevent instability or damage to overloaded support members. Methodology 1300 begins at 1302 and proceeds to 1304 where retraction of extended jacks, supporting the load of the structure, begins.

At 1306 motor velocities of one or more jacks are monitored. Based on the monitored motor velocity values, at 1308, a determination is made as to whether the velocity has increased in one or more jacks. If the velocity has not changed, methodology 1300 recycles to 1306 and continues monitoring the motor velocities of one or more motors.

If the motor velocity has increased at 1308, a determination that load has been removed and the retracting jack is bearing less or no load can be inferred. In at least one embodiment, a comparison of the velocity increase, monitored rates, profile, et cetera is completed, or the increase is monitored for magnitude or length of time, to confirm that the monitored velocity information accords with a reduction in load on the jack.

Based on the velocity increase determined at 1308, the retraction rates are changed at 1310. Changing of the retraction rates can include decreasing rates of retraction in one or more jacks (e.g., jacks with higher motor velocity), increasing rates of retraction in one or more jacks (e.g., jacks with lower motor velocity), or stopping movement in one or more jacks (e.g., jacks with higher motor velocity). By iteratively performing the aspects illustrated in FIG. 13, level or load can remain balanced or within acceptable imbalance parameters during unloading or jack retraction to avoid instability or damage to load bearing members.

After modifying the retraction rates at 1310, a determination is made at 1312 as to whether all jacks are now unloaded (and are, or can be, fully retracted). If the determination at 1312 returns negative (e.g., some jacks still have motor velocity below relative or absolute value, no unloading velocity profile detected), methodology 1300 recycles to 1306 (or optionally 1304 if jacks have ceased retraction mid-methodology) where monitoring continues and retraction of jacks remaining under load is managed. If the determination at 1312 returns positive, methodology 1300 proceeds to end at 1314.

In an embodiment of methodology 1300, unloading can be conducted according to a series of subroutines whereby each jack transitions from loaded, to under-loaded, to unloaded. Elements of methodology 1300 can be repeated such that each jack is or has been in an under-loaded state prior to proceeding to unloading any jack from an under-loaded state. In an alternative or complementary embodiment of methodology 1300, unloading can be conducted according to a series of subroutines intended to maintain level of the structure. Such level, or un-level within thresholds, may be maintained regardless of loading distribution, or can be maintained in a way that the loading distribution is unequal but within a threshold between jacks.

In an embodiment of methodology 1300 (or other methodologies herein), an automatic shutdown may occur at the end of the methodology. The automatic shutdown (e.g., after confirming all jacks are unloaded at 1312, after jacks are at maximum retraction) may de-energize jack motors, decouple jacks and motors, or take other steps for safety or efficiency. In embodiments where automatic shutdown follows full retraction, full retraction can be detected by a change or spike in, e.g., motor velocity or jack velocity. The change may be a negative spike, or drop off, in, e.g., motor velocity or jack velocity. In alternative embodiments a positive spike in, e.g., motor velocity or jack velocity may occur.

In various aspects of this disclosure, velocity may described as increasing or decreasing based on load or other conditions as related to the jacks. These increasing or decreasing velocity relationships hold for particular types of jacks, e.g., acme screw jacks. Where other types of jacks are utilized, however, the relationships described may reverse, for example, velocity and load relating directly rather than inversely. For example, relationships opposite those described in FIGS. 11-13 and elsewhere may result through use of jacks or drives employing, e.g., ball screws. Thus, it will be appreciated that the embodiments disclosed herein embraced herein include configurations similar to the above where the relationships between any two or more of the variables described (e.g., velocity, extension or retraction, load, angular orientation, et cetera) are reversed with regard to the fashion in which they are described above. For example, 1108 could relate to a velocity increase rather than a decrease; 1308 could relate to a velocity decrease rather than an increase; and so forth.

Figure 14:
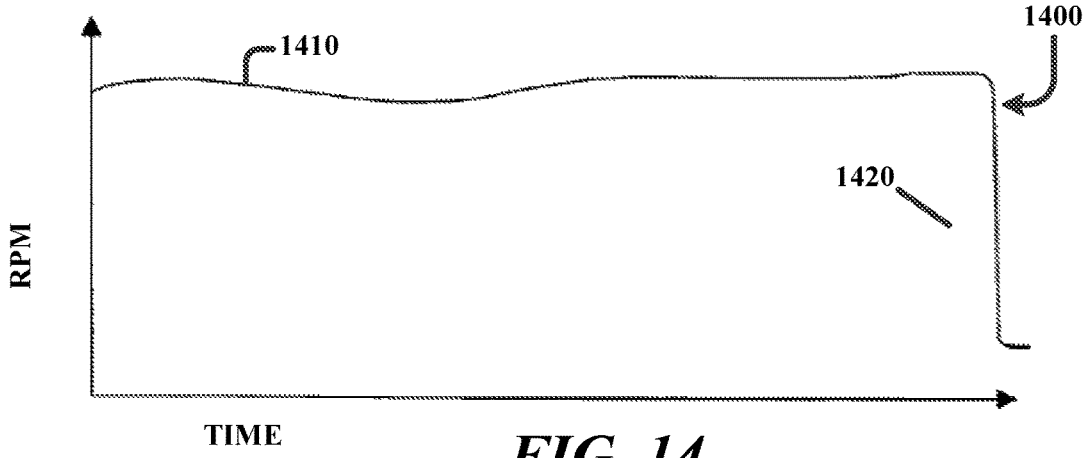
FIG. 14 is a graph depicting a jack velocity curve of an electric motor over time and leading into a motor stall.
Figure 15:
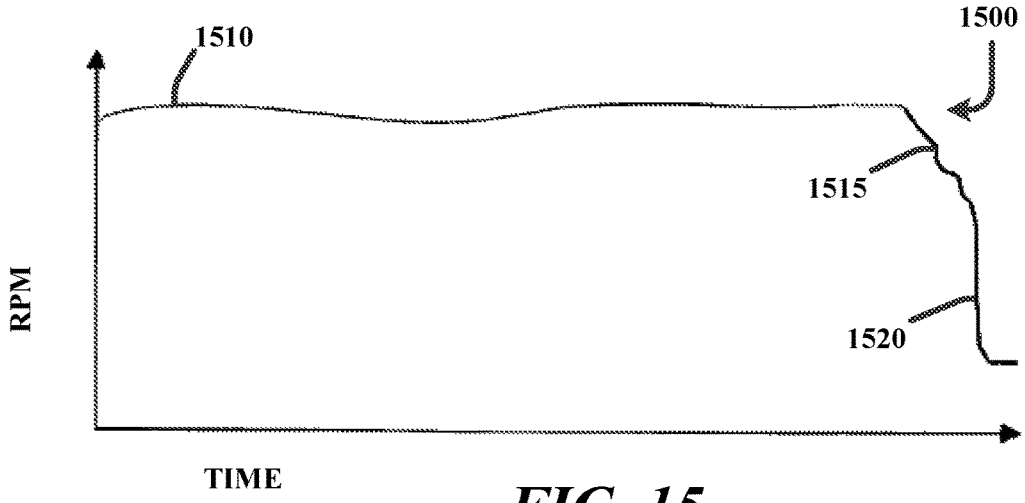
FIG. 15 is a graph depicting a jack velocity curve of an electric motor over time, leading into a motor stall, and including a period of mechanical tightening preceding the stall.
Figure 16:
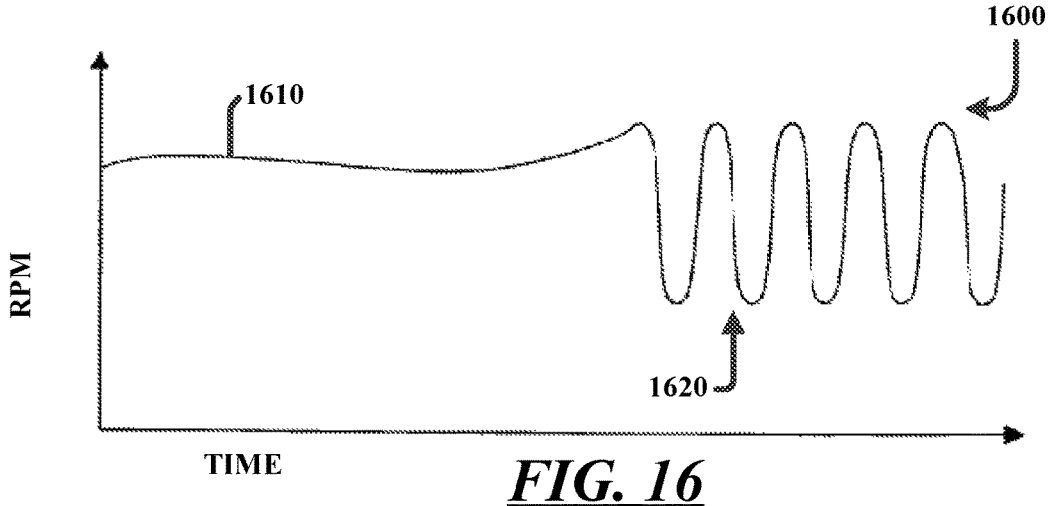
FIG. 16 is a graph depicting a jack velocity curve of a clutched electric motor over time, leading into a period of clutching from a period of normal jack operation.

FIGS. 14-16 illustrate example reference velocities depicted graphically as motor velocity against time. While specific reference velocities are described herein, it is understood that various others can be employed without departing from the scope or spirit of the innovation. Reference velocities can be pre-determined and stored in a controller, or benchmarked through actual operation of systems with which they are associated. Reference velocities can be updated, scaled or averaged for different systems, and/or set to larger or smaller sample sets than those measured to ensure proper identifications of system state or behavior and/or avoid false positives for such identification.

As shown in the graph in FIG. 14, when an electric motor driving a jack stalls, it attempts to generate additional torque to overcome the stall. However, in a stall, no amount of torque can be provided to correct the deviation.

The jack controller 1010, as it monitors the velocity of one or more of plurality of jack drives 1030, will notice a large dip in RPM the moment that the stall is encountered. The jack controller 1010 is programmed to discern a significant difference between velocity dips that occur during "normal" jack travel, and those that occur when one or more of plurality of motors 1030 stall (e.g., at the end of the jack stroke). Empirical measurements can be made to quantify these differences for any given set of plurality of jacks 1040.

Therefore, illustrating a stall, motor velocity curve 1400 of FIG. 14 depicts normal operation 1410, and stall 1420.

The monitored velocities can be adjusted for various known phenomenon related with plurality of jack drives 1030. For example, an initial startup or ramping period (which occurs immediately after motor actuation) can be identified and ignored to avoid resultant changes to RPM being mis-identified as a state or behavior requiring adjustment. Other stabilization periods can also be accounted for to allow motors or other components to stabilize. RPM and other tracked values can also be normalized for various power supplies or power levels, the concurrent operation of other jacks, and other known influences which can systemically impact output or performance. Delay timers (e.g., delaying by periods of time such as those described above) or algorithms recognizing such phenomenon can be employed to avoid mis-identification during start-up or other variable periods.

Further, stall debounce periods representing the length of time that a motor velocity must approach or reach a reference velocity associated with a stall (e.g., 0 RPM) can be established. Jack controller 1010 can include a timer which begins recording the passage of time upon detection of a reference velocity, permitting the debounce period to be observed before a stall is identified and avoiding mis-identification of a stall consequent to short spikes or dips in motor velocity.

If the slope of the velocity curve of the plurality of jack drives 1030 is observed during control, a range of values for the slope of the jack motor velocity curve is determined consistent with a phenomenon known as "mechanical tightening" that occurs when one or more of plurality of jacks 1040 reach a jack stroke limit. The range of values associated with mechanical tightening can be retrievably stored. The jack controller 1010 is programmed to employ a jack stroke limit detection process that includes calculating and monitoring the slope of the velocity curve of the plurality of jack drives 1030 and comparing the calculated slope to the stored slope values associated with mechanical tightening. The jack controller 1010 is programmed to recognize that one or more of plurality of jacks 1040 has reached a stroke limit whenever the monitored velocity curve slope falls within the stored range of velocity curve slope values.

An ideal motor-powered jack 1041, 1042, et cetera, is able to extend or retract more or less freely until it reaches the end of its extension or retraction stroke, at which time all movement ceases. The ideal motor stall occurs instantaneously. However, due to mechanical components such as gears and mechanical linkages in and between a real-world jack and its corresponding drive mechanism, the stall event actually occurs over a small period of time. The tolerances of these components allow for slight movements, even after jack 1041, 1042, et cetera has hit the end of its stroke. The cumulative effect of these tolerances is to allow jack 1041, 1042, et cetera to continue to rotate by a slight amount after hitting its end of stroke.

Mechanical tightening, then, is the forcing together of mechanical components such as gearing and mechanical linkages, within their tolerances, as torque forces accumulate during the period of time when jack 1041, 1042, et cetera has reached the end of a stroke but one or more of the plurality of jack drives 1030 driving jack 1041, 1042, et cetera continue to rotate or translate. One or more of jack motors 1031, 1032, et cetera will continue to rotate until the system is fully tight, meaning that the mechanical components can no longer be moved at max motor torque. At this point a true motor stall begins.

A significant amount of torque must be used during the tightening period to force the mechanical components together. The velocity of a jack motor 1031, 1032, et cetera during tightening is typically less than the normal stall velocity (or less steep than a curve associated with a full stall), but still distinct from a velocity associated with extending or retracting one or more of plurality of jacks 1041, 1042, et cetera between stroke limits. A jack controller 1010 monitoring the velocity and/or power profile of the plurality of jack drives 1030 would encounter something like the image shown in FIG. 15, including a significant decrease in velocity just before the motor mechanism completely stalls.

Therefore, illustrating a stall preceded by mechanical tightening, motor velocity curve 1500 of FIG. 15 depicts normal operation 1510, mechanical tightening 1515, and stall 1520. In embodiments of systems and methods disclosed herein, upon recognition of mechanical tightening or as a stall situation emerges, one or more jack motors can be paused or shut down to avoid stalling.

Various reference velocities can be associated with clutched motors as well. In embodiments of systems herein, a slip clutch can be used with one or more jack motors. In alternative or complementary embodiments, alternative clutch configurations, or no clutches, are used with one or more jack motors. As shown in FIG. 16, a continuous series of clutching periods appears as a regular, periodic curve of dropping and increasing RPM. This curve may have, for example, a sinusoidal or a triangular wave shape, depending on the specific design of the plurality of jack drives 1030 and respective clutch mechanisms.

The amplitude of the clutching pattern is significant, because clutch systems for transferring torque from one or more jack drives 1030 to a jack 1040 are designed to store a comparatively large amount of energy (e.g., enough energy to help the jack 1040 overcome brief periods of sticking and/or loading).

Thus, a stroke limit detection process can include detecting a clutching pattern. By this technique, the jack controller 1010 processes the velocity curve by measuring the velocity of the plurality of jack drives 1030. In one embodiment, the measured velocity can be filtered through a high-pass or band-pass filter. In this way, the band clutching frequencies or velocities can be isolated from the velocity signal/information, and additional calculations can be performed to determine if a clutching situation exists.

This embodiment can employ knowledge of high and low velocities or frequencies associated with clutching, which can be pre-programmed, detected, and/or inferred through other means. In addition, as described above, in-rush and other predictable phenomenon can be included with such information or models to avoid mis-identification of motor state or behavior (or that of associated jacks). Further, similar to aspects described above, a clutch debounce period can be determined to disregard brief transients in RPM.

Therefore, illustrating a stall, motor velocity curve 1600 of FIG. 16 depicts normal operation 1610, and clutching pattern 1620.

In another example, a ground contact profile of a motor velocity curve can show a substantially steady motor velocity (RPM) during normal operation. When the jack comes into contact with the ground or another immovable object, the motor velocity will decrease along a substantially constant slope until stalling or clutching when velocity approaches zero.

In addition to matching contours of various curves or identifying matching values, various thresholds or tolerances can be observed in determining the condition of a jack or motor. For example, various RPM thresholds can be utilized such that increases or decreases above an average RPM in a limited or unlimited period of time cause certain inferences to be reached by a controller. For example, a drop in RPM of 10%, 25%, 50%, et cetera, from an average running RPM in the preceding minute may be used to infer a stall. In another embodiment, a tolerance of, e.g., 10%, 25%, 50%, et cetera, can be employed such that a 5% deviation will not trigger action, but a deviation greater than the tolerance amount causes an inference to be reached by a controller.

Further, relationships can be provided for balancing the loads of motors or jacks associated with the same. In this regard, a velocity ratio can be enforced (e.g., by jack controller 1010) between two or more jack motors. The velocity balance ratio can be defined as:

$$K_{balance} \sim (V_{high}/V_{low})$$

or another suitable ratio, wherein the relationship of the constant in regard to the ratio of velocities can determine whether the loading is in or out of balance. $V_{high}$ can be defined as the highest velocity of any jack motor, the highest velocity reached by one jack motor, or the highest acceptable velocity of any jack motor, in various embodiments. $V_{low}$ can be defined as the lowest velocity of any jack motor, the lowest velocity reached by one jack motor, or the lowest acceptable velocity of any jack motor, in various embodiments. This parameter can be set between, for example, 0 and 1, to a value suiting the desired loading profile. By setting this value to zero in the controller, the jacks are always treated as balanced, effectively disabling this feature.

The velocity balance ratio can be used in conjunction with a balance recovery ratio. This constant, $K_{recover}$, is set to a velocity ratio between the two jacks that must be achieved before increasing the RPM of a more heavily-loaded jack (or decreasing the RPM of a more lightly-loaded jack). The balance recovery ratio period can be employed, for example, when the velocity balance ratio is exceeded. Further, there can be a recovery period track by a timer of a controller to ensure that balance has been accomplished, rather than falsely identified based on inconsistent readings.

Figure 17:
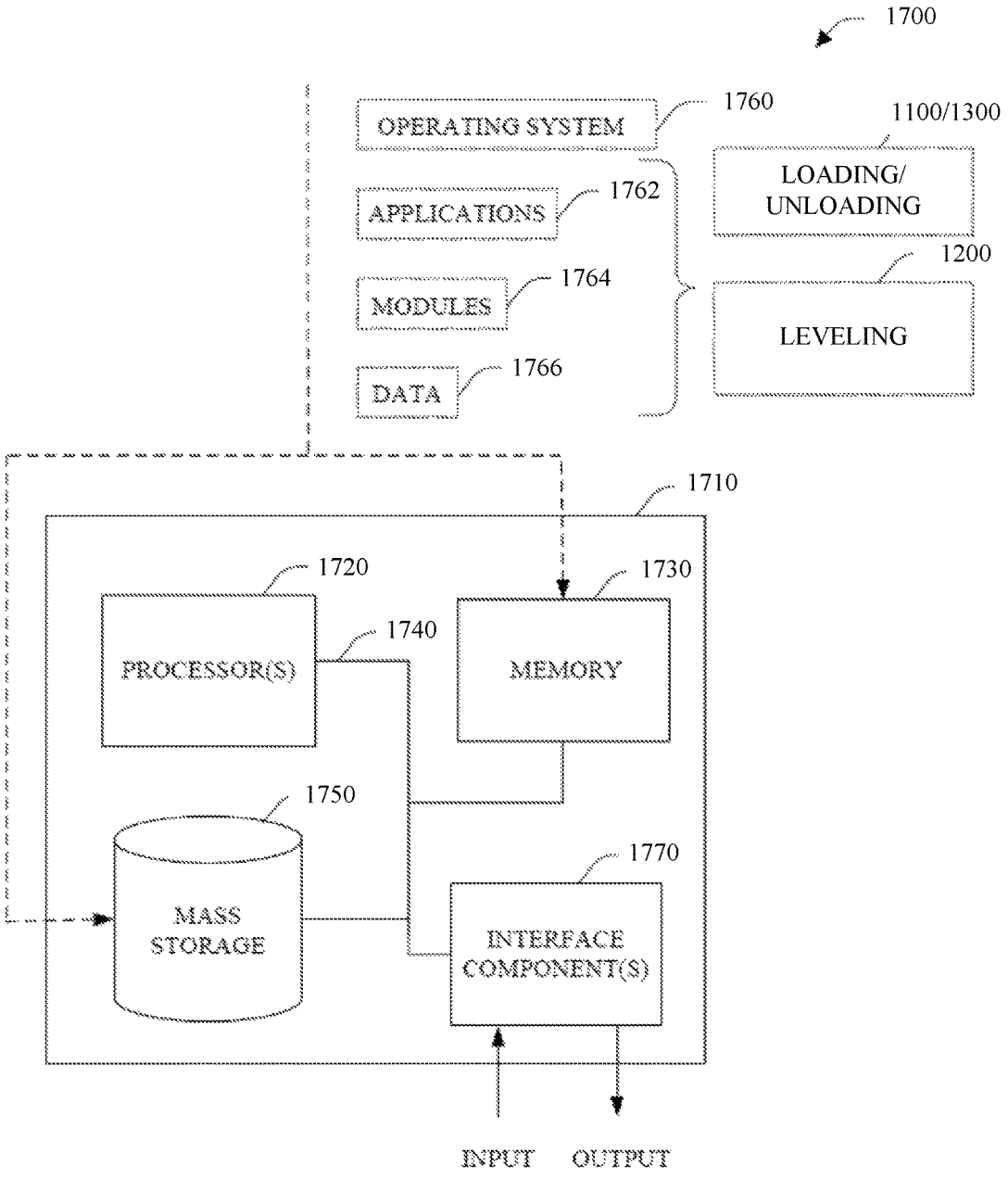
FIG. 17 illustrates an example environment which can be used in conjunction with aspects disclosed herein.

In order to provide a context for the claimed subject matter, FIG. 17 as well as the following discussion provide a brief, general description of a suitable environment in which various aspects of the subject matter can be implemented. This environment is only an example and is not intended to suggest any limitation as to scope of use or functionality.

While some of the above disclosed techniques can be described in the general context of computer-executable instructions of programs that runs on one or more computers or network hardware, those skilled in the art will recognize that aspects can also be implemented in combination with various alternative hardware, software, modules, et cetera. As suggested earlier, program modules and software components include routines, programs, components, data structures, among other things that perform particular tasks and/or implement particular abstract data types. Moreover, those skilled in the art will appreciate that the above systems and methods can be practiced with various computer system configurations, including single-processor, multi-processor or multi-core processor computer systems, mini-computing devices, mainframe computers, as well as personal computers, hand-held computing devices (e.g., personal digital assistant, portable gaming device, smartphone, tablet, Wi-Fi device, laptop, phone, among others), microprocessor-based or programmable consumer or industrial electronics, and the like. Aspects can also be practiced in distributed computing environments where tasks are performed by remote processing devices that are linked through a communications network. However, some, if not all aspects of the claimed subject matter can be practiced on stand-alone computers. In a distributed computing environment, program modules may be located in one or both of local and remote memory storage devices.

With reference to FIG. 17, illustrated is an example computer 1710 or computing device (e.g., desktop, laptop, server, hand-held, programmable consumer or industrial electronics, set-top box, game system, et cetera). The computer 1710 includes one or more processor(s) 1720, memory 1730, system bus 1740, mass storage 1750, and one or more interface components 1770. The system bus 1740 communicatively couples at least the above system components. However, it is to be appreciated that in its simplest form the computer 1710 can include one or more processors 1720 coupled to memory 1730 that execute various computer executable actions, instructions, and or components stored in memory 1730.

The processor(s) 1720 can be implemented with a general purpose or specially manufactured processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any processor, controller, microcontroller, or state machine. The processor(s) 1720 may also be implemented as a combination of computing devices, for example a combination of a DSP and a microprocessor, a plurality of microprocessors, multi-core processors, one or more microprocessors in conjunction with a DSP core, or any other such configuration.

The computer 1710 can include or otherwise interact with a variety of computer-readable media to facilitate control of the computer 1710 to implement one or more aspects of the claimed subject matter. The computer-readable media can be any available media that can be accessed by the computer 1710 and includes volatile and nonvolatile media, and removable and non-removable media. By way of example, and not limitation, computer-readable media may comprise computer storage media and communication media.

Computer storage media includes volatile and nonvolatile media, and removable and non-removable media, implemented in any method or technology for storage of information such as computer-readable instructions, data structures, program modules, or other data. Computer storage media includes, but is not limited to memory devices (e.g., random access memory, read-only memory, electrically erasable programmable read-only memory, et cetera), magnetic storage devices (e.g., hard disk, floppy disk, cassettes, tape, et cetera), optical disks (e.g., compact disk, digital versatile disk, et cetera), and solid state devices (e.g., solid state drive, flash memory drive such as a card, stick, or key drive, et cetera), or any other medium which can be used to store the desired information and which can be accessed by the computer 1710.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Also, a connection can be a communication medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio and microwave are included in the definition of communication medium. Combinations of the above can also be included within the scope of computer-readable media.

Memory 1730 and mass storage 1750 are examples of computer-readable storage media. Depending on the exact configuration and type of computing device, memory 1730 may be volatile (e.g., RAM), non-volatile (e.g., ROM, flash memory, et cetera) or some combination of the two. By way of example, the basic input/output system (BIOS), including basic routines to transfer information between elements within the computer 1710, such as during start-up, can be stored in nonvolatile memory, while volatile memory can act as external cache memory to facilitate processing by the processor(s) 1720, among other things.

Mass storage 1750 includes removable/non-removable, volatile/non-volatile computer storage media for storage of large amounts of data relative to the memory 1730. For example, mass storage 1750 includes, but is not limited to, one or more devices such as a magnetic or optical disk drive, floppy disk drive, flash memory, solid-state drive, or memory stick.

Memory 1730 and mass storage 1750 can include, or have stored therein, operating system 1760, one or more applications 1762, one or more program modules 1764, and data 1766. The operating system 1760 acts to control and allocate resources of the computer 1710. Applications 1762 include one or both of system and application software and can exploit management of resources by the operating system 1760 through program modules 1764 and data 1766 stored in memory 1730 and/or mass storage 1750 to perform one or more actions. Accordingly, applications 1762 can turn computer 1710 into a specialized machine in accordance with the logic provided thereby.

All or portions of the claimed subject matter can be implemented using programming and/or engineering techniques to produce software, firmware, hardware, or any combination thereof to control a computer to realize the disclosed functionality. By way of example and not limitation, methodologies 1100, 1200, and/or 1300 can be, or form part of, an application 1762, and include one or more modules 1764 and data 1766 stored in memory and/or mass storage 1750 whose functionality can be realized when executed by one or more processor(s) 1720.

In accordance with one particular embodiment, the processor(s) 1720 can correspond to a system on a chip (SOC) or like architecture including, or in other words integrating, both hardware and software on a single integrated circuit substrate. Here, the processor(s) 1720 can include one or more processors as well as memory at least similar to processor(s) 1720 and memory 1730, among other things. Conventional processors include a minimal amount of hardware and software and rely extensively on external hardware and software. By contrast, an SOC implementation of processor can be more powerful, as it embeds hardware and software therein that enable particular functionality with minimal or no reliance on external hardware and software. For example, instructions for methodologies 1100, 1200, and 1300 (and/or associated components) and can be embedded within hardware in a SOC architecture.

The computer 1710 also includes one or more interface components 1770 that are communicatively coupled to the system bus 1740 and facilitate interaction with the computer 1710. By way of example, the interface component 1770 can be a port (e.g., serial, parallel, PCMCIA, USB, FireWire, et cetera) or an interface card (e.g., sound, video, et cetera) or the like. In one example implementation, the interface component 1770 can be embodied as a user input/output interface to enable a user to enter commands and information into the computer 1710 through one or more input devices (e.g., pointing device such as a mouse, trackball, stylus, touch pad, keyboard, microphone, joystick, game pad, satellite dish, scanner, camera, other computer, et cetera). In another example implementation, the interface component 1770 can be embodied as an output peripheral interface to supply output to displays (e.g., CRT, LCD, plasma, LED, et cetera), speakers, printers, and/or other computers, among other things. Still further yet, the interface component 1770 can be embodied as a network interface to enable communication with other computing devices, such as over a wired or wireless communications link.

While aspects above are described at times as standalone or all-inclusive systems, it is understood that aspects herein can use the technology described above with various network elements (e.g., servers, hubs, routers, et cetera) to accomplish multi-system or distributed network implementation of inventive techniques disclosed. Nothing herein should be construed as in any way limiting the network or distributive scope of embodiments embraced.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As utilized herein, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Illustrative embodiments are described herein to illustrate the spirit of the invention rather than detail an exhaustive listing of every possible variant. It will be apparent to those skilled in the art that the above devices and methods may incorporate changes and modifications without departing from the scope or spirit of the claimed subject matter. It is intended to include all such modifications and alterations within the scope of the claimed subject matter. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system for leveling a structure, the system comprising:

two or more jack drive mechanisms each coupled to an associated jack that supports the structure, the two or more jack drive mechanisms configured to extend or retract the associated jacks; and a controller coupled to the two or more jack drive mechanisms, the controller configured to cause extension or retraction of the associated jacks, the controller further configured to monitor a rate of extension of each of the associated jacks and level the structure by varying the rate of extension of at least one of the associated jacks based on feedback received from another of the associated jacks.

2. The system of claim 1, wherein the controller varies the rate of extension of one of the associated jacks in response to a change in the rate of another of the associated jacks.

3. The system of claim 1, wherein the controller actuates the two or more jack drive mechanisms via a command, and wherein the controller modifies the command in response to a change in the rate of another of the associated jacks.

4. The system of claim 1, wherein, in response to monitoring a decrease in the rate, the controller is configured to:

increase the rate in another of the two or more jack drive mechanisms; or decrease the rate in another of the two or more jack drive mechanisms.

5. The system of claim 1, wherein, in response to monitoring an increase in the rate, the controller is configured to:

increase the rate in another of the two or more jack drive mechanisms; or decrease the rate in another of the two or more jack drive mechanisms.

6. The system of claim 1, wherein the two or more jack drive mechanisms each include a sensor configured to measure the rate of extension of the associated jack.

7. The system of claim 6, wherein the sensor is selected from the group consisting of a tachometer, a Hall effect sensor, and an optical encoder, and any combination thereof.

8. The system of claim 1, wherein the controller further includes a comparator configured to compare the rate to a reference value.

9. The system of claim 1, wherein the associated jacks of the two or more jack drive mechanisms are spaced apart at different locations on the structure.

10. The system of claim 9, wherein the controller is configured to cause at least two of the two or more jack drive mechanisms to each extend or retract the associated jack at different rates.

11. The system of claim 10, wherein the controller detects grounding of the associated jack of at least one of the two or more jack drive mechanisms based on a change in the rate associated therewith, and the controller calculates the rate provided by another of the jack drive mechanisms to the associated jack thereof to facilitate balanced loading of the associated jacks during a grounding operation.

12. The system of claim 10, the different rates are calculated to facilitate balanced unloading of the two or more jacks during a retraction operation.

13. The system of claim 12, the jack controller is configured to shut down the two or more jack drive mechanisms based on the one or more jack velocities when at least one of the two or more jacks is at full retraction.

14. The system of claim 10, further comprising a tilt sensor that produces an angular signal indicative of an attitude of the structure, wherein the controller is configured to calculate the different rates based on the attitude of the structure and a reference angle.

15. The system of claim 14, wherein the different rates are calculated to adjust the attitude of the structure to a target attitude.

16. The system of claim 15, wherein the controller is configured to shut down at least one of the two or more jack drive mechanisms when a stroke length of the associated jack associated therewith is insufficient to modify the attitude of the structure to the target attitude.

17. The system of claim 1, wherein at least one of the jack drive mechanisms is hydraulically powered.

18. The system of claim 1, wherein at least one of the jack drive mechanisms is electrically powered.

19. The system of claim 1, wherein at least one of the rate is selected from the group consisting of a rotational speed, a linear speed, and a relationship between two or more known or monitored variables of the system, and combinations thereof.

20. A method for leveling a structure supported by two or more jacks, comprising:

monitoring a velocity at which each of the two or more jacks raise or lower the structure; and modifying at least one of the jack velocities of at least one of the jacks in response to a change detected in the jack velocity of another one of the jacks.

21. The method of claim 20, wherein the jack velocity of at least one of the jacks is decreased in response to a decrease in the jack velocity of another one of the jacks during a grounding operation.

22. The method of claim 20, wherein the jack velocity of at least one of the jacks is decreased in response to an increase in the jack velocity of another one of the jacks during a retracting operation.

23. The method of claim 20, wherein the method further comprises driving the two or more jacks to raise or lower the structure.

24. The method of claim 20, wherein the at least one of the jack velocities is modified via a controller.

25. The method of claim 20, wherein each of the velocities is measured by a velocity sensor that is in communication with the controller and configured to detect the change in at least one of the jack velocities.

26. The method of claim 20, further comprising:

monitoring an angular orientation of the structure;

comparing the angular orientation of the structure to a reference angle; and calculating extension or retraction of the two or more jacks to modify the angular orientation of the structure to a target angular orientation.

27. The method of claim 26, wherein the jack velocities are modified in response to the calculated extension or retraction during a leveling operation.

28. The method of claim 26, wherein the target angular orientation is substantially perpendicular to a direction of gravity.

29. The method of claim 26, wherein the target angular orientation is monitored about at least two axes.

30. The method of claim 29, wherein the at least two axes include a pair of perpendicular axes extending in a plane defined by respective points at which each of the jacks engages the structure.

* * * * *